United States Patent [19]

Salmang

[11] Patent Number: 5,058,759

[45] Date of Patent: Oct. 22, 1991

[54] PLASTIC DAIRY PRODUCT CONTAINER HAVING TAMPER EVIDENT LID AND METHOD OF PRODUCTION

[75] Inventor: Rodolfo Salmang, Bogota, Colombia

[73] Assignee: The Dow Chemical Company, Midland, Mich.

[21] Appl. No.: 603,360

[22] Filed: Oct. 26, 1990

[51] Int. Cl.[5] ..... B65D 17/34

[52] U.S. Cl. ..... 220/270; 220/266

[58] Field of Search ..... 220/265, 266, 270, 355, 220/90.2, 90.4; 215/253; 206/604, 601, 634

[56] References Cited

U.S. PATENT DOCUMENTS

| | | | |
|---|---|---|---|
| 3,403,812 | 10/1968 | Weber | 220/266 |
| 3,980,224 | 9/1976 | Yasuda | 206/604 |
| 4,090,660 | 5/1978 | Schram et al. | 220/270 |
| 4,098,406 | 7/1978 | Otten et al. | 206/604 X |
| 4,215,793 | 8/1980 | Packard | 220/270 |
| 4,322,015 | 3/1982 | Bailey | 220/266 |
| 4,438,865 | 3/1984 | Scattaregia | 220/266 |
| 4,721,210 | 1/1988 | Lawrence et al. | 220/266 |
| 4,781,294 | 11/1988 | Croce | 206/604 X |
| 4,828,137 | 5/1989 | Batson et al. | 220/270 |
| 4,966,294 | 10/1990 | Mack et al. | 220/265 |

*Primary Examiner*—Stephen Marcus
*Assistant Examiner*—Paul Schwarz
*Attorney, Agent, or Firm*—Douglas N. Deline

[57] ABSTRACT

A plastic, tamper resistant container particularly adapted for the marketing of dairy products comprising a cup and a lid having a tab extending peripherally therefrom such that application of a force to the tab sufficient to remove the lid, initiates fracture propagation and tearing of the lid, and a process for manufacture thereof.

5 Claims, 1 Drawing Sheet

PLASTIC DAIRY PRODUCT CONTAINER HAVING TAMPER EVIDENT LID AND METHOD OF PRODUCTION

BACKGROUND OF THE INVENTION

The present invention is directed to a container for use in food products, particularly dairy products, such as yogurt or thickened dairy based drinks. More particularly, the present invention relates to a one use, snap-on lid having tamper evident features.

Containers for use with high or medium viscosity dairy foods and drinks must maintain an effective seal or barrier to protect the product for short periods of time, usually up to 30 days. It is known in the art to employ aluminum foil lids which are sealed to the cup portion of the container by the use of an adhesive. However, such containers are difficult to recycle because of the presence of metal which must be separated from plastic portions of the container prior to recycling. In addition, the aluminum foil often spontaneously releases from the dairy container or alternatively tears in an erratic manner when pealed by the consumer. Beneficially, however, the aluminum foil seal clearly indicates the fact that the container has been opened thereby providing an inherent indication of tampering with the container.

It is also previously known to thermoform from plastic a tight fitting lid which is placed over a lip edge of the container top to seal dairy containers and the like. Disadvantageously such container lids are capable of opening and reclosing numerous times thereby making such lids unacceptable as a tamper evidencing device.

It would be desirable if there were provided a dairy product container that is in the form of a cup of a generally circular cross-section, having a lip edge, and a lid, adapted for covering the cup and engaging the lip edge: said lid being formed of a thermoplastic resin and being capable of initially covering the container by engagement with the lip edge of the cup, and upon removal being subject to fracture propagation and tearing. Desirably the lid and cup are thermoformed from a relatively thin, extruded sheet of thermoplastic resin.

SUMMARY OF THE INVENTION

According to the present invention there is now provided a thermoplastic container comprising cup and lid portions:

1) said cup portion comprising base and sidewalls, said sidewalls terminating in a plane spatially removed from the base in a lip edge which describes an opening; and 2) said lid being of a size and shape corresponding to the size and shape of the cup opening and being adapted for covering the cup opening by frictionally engaging the lip edge by means of a peripheral groove, and further comprising a tab extending from said peripheral groove;

wherein the container is characterized by the fact that the lid undergoes fracture propagation and tearing upon removal from the container by application of a lifting force to the tab sufficient to remove the lid.

The containers of the invention are ideally suited for packaging of yogurt and other thickened dairy products. Because no metal foil is employed, the containers including lids thereof may be easily recycled by remelting the thermoplastic resin after suitable cleaning or other processing steps. Advantageously, the lid clearly indicates opening of the container because of the requisite fracture propagation properties of the lid giving the container an inherent tamper evidencing property.

DETAILED DESCRIPTION

The thermoplastic containers according to the present invention may be prepared from any suitable thermoplastic resin by any of the well known thermoforming techniques. Highly desirable materials of construction include polystyrene resins and rubber-modified polystyrene resins, such as resins containing polybutadiene or similar rubber prepared by solution, mass, emulsion or other graft copolymerization process, or by blending of separately polymerized polymeric components. Also suitable are blends of polystyrene and rubber-modified polystyrene resins. Additives may also be included in the thermoplastic resins to provide opacity, color, improved melt flow, etc. For thermoforming, the thermoplastic resin is generally heat plastified and extruded into a thin sheet by any suitable extrusion process. As is known in the art, this procedure may introduce molecular orientation into the sheet providing different physical properties in the direction of sheet extrusion (machine direction) and perpendicular thereto (cross-direction). The sheet may be cooled and thermoformed or thermoformed directly after formation by any suitable technique to provide cups for the containers of the desired volume and shape. Generally the containers will possess a circular cross-section although the skilled artisan will appreciate that cross-sectional shapes other than circles may also be employed if desired.

Lids for the containers of the invention are similarly prepared through thermoforming techniques as above explained. The type of thermoplastic resin utilized in the preparation of the lids, and particularly, the orientation of the lid with respect to the machine direction of the extruded sheet are carefully controlled in order to obtain the benefits of the present invention.

Figure 1:
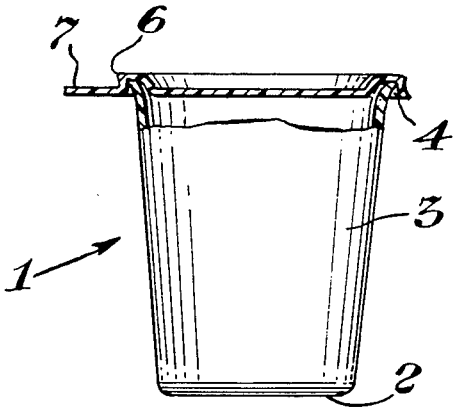
FIG. 1 provides a side elevation of a container according to the present invention.

In FIG. 1 there is illustrated a thermoformed thermoplastic container according to the present invention comprising a cup portion, 1, having a base, 2, and a sidewall, 3, attached to the periphery of said base. The sidewall terminates in an outwardly projecting lip edge, 4, which may also be of slightly thicker cross-section than the sidewall to provide improved strength. The container is sealed by means of a lid, 5, corresponding in size to the opening of the container. The outer periphery of the lid comprises a groove, 6, running peripherally around the lid, and a projecting tab portion, 7, attached thereto.

Figure 2:
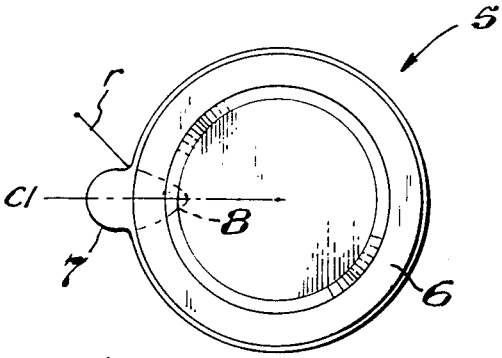
FIG. 2 shows the lid and area of fracture propagation.

In FIG. 2, the lid, 5, is depicted in greater detail. The tab, 7, is seen to project radially along an axial center line Cl. The tab is attached to the lid so as to provide a transition from the tab to the lid over a radius, r. After opening, the lid typically exhibits fracture propagation and tearing at a separation line, 8, where the tab separates from the lid.

As an aide in ensuring stress induced propagation and tearing of the lid it is desirable that the radius, r, be as small as possible, most preferably less than or equal to 0.1 mm. In this way it is ensured that stress caused by application of an opening force to tab, 7, is concentrated in the region where fracture propagation is desired.

Suitable materials of construction for the lid are selected so that attachment of the lid to the cup (i.e. closure of the container) by such means as the pressure provided by a roller does not cause destruction of the lid, but removal of the lid by lifting of the tab, 7, leads to stress induced fracture propagation.

Figure 3:
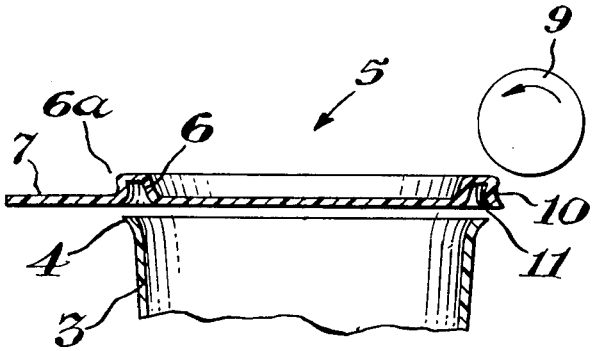
FIG. 3 provides a cross-section view of the lid and cup during the container closure process.

For example, in one embodiment of the invention illustrated in FIG. 3, the filled containers, 1, are sealed by placing the lid, 5, in approximate alignment with the opening of the container and applying a uniform engaging force to the lid by means of a roller, 9, which causes the lid to press over the lip edge by flexing and expanding the groove, 6. Once in place the outer perimeter portion of the groove, 10, frictionally engages the underside of the lip edge, 4, thereby preventing release of the lid. During the sealing process it is seen that the normal width of groove, 6, at its minimum internal point, 11, must expand to a size that is slightly larger than the width of the lip, 4, and thereafter snap back to a lesser size thereby securely engaging the lid to the container lip. It should be noted that while the lid is engaged on the container, a frictional fit is obtained by the fact that the internal width of groove, 6, is not allowed to contract to the size of its original unstressed state. Accordingly, in the sealed condition, the thermoplastic material in the external curve portion of the groove, 6*a*, is retained in a stressed condition.

Figure 4:
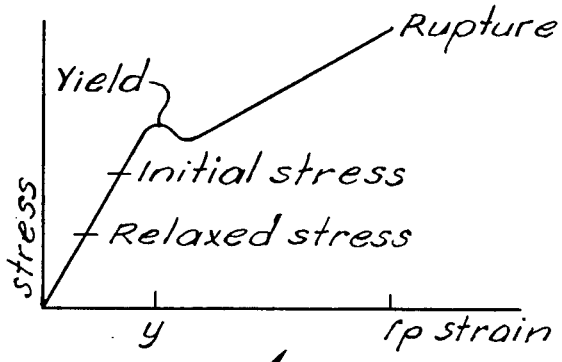
FIG. 4 is a stress/strain graph for a resin suitable for use in the present invention.

Thermoplastic materials are normally characterized by a number of physical properties such as modulus of elasticity and practical toughness. Practical toughness is determined as the area beneath a graph of stress as a function of strain for a suitable sample. A typical example of such a stress/strain curve is depicted in FIG. 4. The initial slope of the curve is the modulus of elasticity of the thermoplastic material. As may be seen, increasing strain results in increased stress until a point, y, where an inversion occurs and increasing strain does not produce increased stress. This point, called the yield-stress point, cannot be exceeded without deformation of the plastic material occurring. Destruction of the sample occurs at rp, the rupture point. The lids of the present invention are formed of a material such that application of the lid to the cup portion imparts a stress to the material in the external curve portion of the groove, 6*a*, (FIG. 3) that does not exceed the yield stress of the thermoplastic resin. In FIG. 4 it is seen that initial stress should occupy an area of the stress-strain curve that is less than the point indicated as y.

It is known that thermoplastic materials may possess stress relaxation properties. That is, a thermoplastic which is stressed will, over time, relax or lessen that stress. At such later time this lower level of stress is called the relaxed stress value. FIG. 4 indicates typical values of initial stress and relaxed stress. Stress relaxation results in creep or flow of the plastic and a change in the sample's size. If excess creep occurs in lids utilized in the present invention, the lid will no longer fit tightly to the body of the container. Thus a further desirable feature of the present invention is that the lids be formed of a thermoplastic resin that is not subject to excessive stress relaxation.

In order to remove the lid from the container the consumer grasps the projecting tab, 7, and applies a force in order to expand the width of the peripheral groove, 6, in the region adjacent to the tab mounting area. Because the opening force is localized, and further because the circumferential groove is not uniformly expanded as in the lid closure process but instead, the opening force is concentrated in the outer perimeter portion of the groove, 10, near the tab, it is possible to ensure fracture propagation and tearing of the lid during its removal.

Referring again to FIG. 4, it is desirable that upon application of such opening force, the localized stress imparted to the lid in the region surrounding the tab exceed the rupture stress for the thermoplastic lid material. The practical effect of this occurrence is to cause fracture propagation in the region of the lid near the tab and tearing of the thermoplastic material. Once torn, the lid loses its ability to securely engage the lip of the thermoplastic container and may be easily removed. The torn lid also clearly indicates that the container has been previously opened.

By careful selection of the type of thermoplastic polymer used in the lid, and by controlling the geometry or orientation of the polymer within the lid it is possible to provide a lid construction wherein the initial stress imparted to the lid in the closing process does not exceed the yield stress of the polymer, but the localized stress imparted to the lid during opening exceeds the rupture stress of the polymer. It should also be noted that the amount of stress imparted to the lid during opening depends on the polymer's stress relaxation properties. As previously mentioned, the degree of stress relaxation should not be sufficient to reduce the stress experienced upon opening of the lid (relaxed stress + imparted stress on opening) to a degree less than the rupture stress of the polymer, nor should sufficient creep occur such that the lid no longer tightly fits the container. Accordingly, preferred thermoplastic polymer resins for use in thermoforming lids according to the present invention possess low stress relaxation abilities. That is, the value of relaxed stress should be close to the value of initial stress. Preferably, after 30 days the relaxed stress value should be 50% or more of the initial stress.

A preferred resin for use in preparing of container lids according to the present invention is a blend of from 30 to 75 percent high impact polystyrene (HIPS) and from 70 to 25 percent crystalline polystyrene. Such blends possess desirable orientation properties. In a highly desirable embodiment it has been found that by orienting the tab centerline, Cl, in a direction which is between the machine direction and cross direction of the extruded sheet, desirable lid performance properties are obtained.

Figure 5:
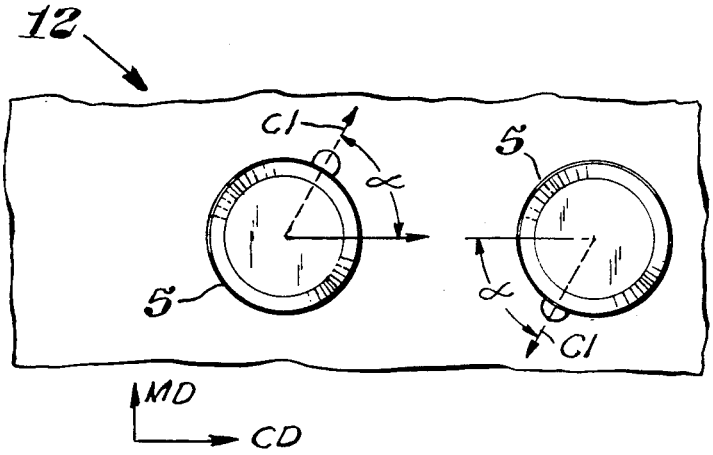
FIG. 5 illustrates preferred alignment of the extruded thermoplastic sheet for thermoforming of lids according to the invention.

FIG. 5 illustrates this desired orientation for the thermoformed lids. In the drawing there is depicted the extruded polymer sheet, 12, having a machine direction (MD) and cross direction (CD). Lids, 5, are thermoformed and trimmed in place or trimmed later. Each lid has a tab centerline, Cl, oriented with respect to the cross direction by an angle, $\alpha$. In a highly preferred embodiment according to the present invention, the angle, $\alpha$, is selected so as to provide suitable fracture propagation and tearing of the lid. Highly preferably the performance of the lid has been found to be best when the angle, $\alpha$, lies between the 70° and 80°, most preferably between 71° and 76°.

At values of $\alpha$ less than the preferred range it is not possible to ensure that fracture propagation will occur in the lid. At values of $\alpha$ greater than the previously stated amounts, spontaneous breakage of the lid upon application to the container may result.

What is claimed is:

1. A thermoplastic container comprising cup and lid portions;

1) said cup portion comprising a base and sidewall, said sidewall terminating in a plane spatially removed from the base in a lip edge which describes an opening; and 2) said lid being of a size and shape corresponding to the size and shape of the cup opening and being adapted for covering the cup opening by frictionally engaging the lip edge by means of a peripheral groove, and further comprising a tab extending from said peripheral groove;

wherein the container is characterized by the fact that the lid is thermoformed from a relatively thin, extruded sheet of thermoplastic resin and undergoes fracture propagation and tearing due to orientation of the tab centerline in a direction between the machine direction and cross direction of the extruded sheet upon removal from the container by application of a lifting force to the tab sufficient to remove the lid.

2. A container according to claim 1 wherein the thermoplastic comprises from 30 to 75 weight percent rubber modified high impact polystyrene and from 70 to 25 weight percent crystalline polystyrene.

3. A container according to claim 2 wherein the lid is thermoformed from an extruded sheet of the thermoplastic resin blend such that the centerline of the tab is oriented between 70° and 80° from the cross direction of the extruded sheet.

4. A container according to claim 3 wherein the radius of curvature between the tab and lid circumference is less than or equal to 0.1 mm.

5. A process for preparing a container according to claim 1 comprising thermoforming the lid and cup portion in a manner such that the centerline of the tab is oriented so as to be between 70° and 80° from the cross direction of the extruded sheet.

* * * * *